US010502242B2

(12) United States Patent
Schwarz et al.

(10) Patent No.: US 10,502,242 B2
(45) Date of Patent: Dec. 10, 2019

(54) HYDRAULIC CYLINDER WITH END POSITION DAMPING

(71) Applicant: KOMATSU MINING GERMANY GMBH, Düsseldorf (DE)

(72) Inventors: Henry Schwarz, Monheim (DE); Christian Hess, Bochum (DE); Oliver Martens, Marl (DE)

(73) Assignee: KOMATSU MINING GERMANY GMBH, Düsseldorf (DE)

( * ) Notice: Subject to any disclaimer, the term of this patent is extended or adjusted under 35 U.S.C. 154(b) by 360 days.

(21) Appl. No.: 14/649,303

(22) PCT Filed: Nov. 12, 2013

(86) PCT No.: PCT/DE2013/000693
§ 371 (c)(1),
(2) Date: Jun. 3, 2015

(87) PCT Pub. No.: WO2014/086327
PCT Pub. Date: Jun. 12, 2014

(65) Prior Publication Data

US 2015/0345520 A1 Dec. 3, 2015

(30) Foreign Application Priority Data

Dec. 4, 2012 (DE) ..... 10 2012 024 155

(51) Int. Cl.
*F15B 15/22* (2006.01)
*F15B 11/04* (2006.01)
(Continued)

(52) U.S. Cl.
CPC ..... *F15B 15/224* (2013.01); *E02F 9/2214* (2013.01); *E02F 9/2271* (2013.01);
(Continued)

(58) Field of Classification Search
CPC ..... F15B 15/224; F15B 15/223; F15B 15/22; F15B 15/222; F15B 11/0413
(Continued)

(56) References Cited

U.S. PATENT DOCUMENTS 840,877 A * 1/1907 Steedman ..... F15B 15/224 137/102
2,382,457 A * 8/1945 Wertman ..... F41A 9/50 91/210
(Continued)

FOREIGN PATENT DOCUMENTS

DE 2016980 A1 * 10/1971 ..... F15B 15/224
DE 3825453 A1 * 2/1990 ..... F15B 15/223
(Continued)

OTHER PUBLICATIONS

DE 2016980 machine translation to English from espacenet. 1971.*
(Continued)

*Primary Examiner* — Thomas E Lazo
*Assistant Examiner* — Michael Quandt
(74) *Attorney, Agent, or Firm* — Henry M. Feiereisen LLC

(57) ABSTRACT

A hydraulic cylinder includes a cylinder having axially spaced-apart first and second bores, and a piston having a piston rod and arranged in the cylinder for movement between two end positions and dividing the cylinder into a piston side and a piston-rod side. A hydraulic pump pumps hydraulic oil into the piston side to move the piston from one end position toward the other end position while hydraulic fluid is discharged from the piston-rod side via the first bore and a first outlet line. A throttling device is operably connected to the cylinder to throttle a flow of the hydraulic fluid as the piston moves past and seals the first bore so that hydraulic fluid is discharged via the second bore, thereby
(Continued)

reducing a delivery amount of the hydraulic oil and thereby braking and damping a movement of the piston toward the other one of the end positions.

8 Claims, 1 Drawing Sheet

(51) Int. Cl.
*F15B 11/048* (2006.01)
*E02F 9/22* (2006.01)

(52) U.S. Cl.
CPC ..... *E02F 9/2296* (2013.01); *F15B 11/048* (2013.01); *F15B 11/0413* (2013.01); *F15B 2211/20546* (2013.01); *F15B 2211/30505* (2013.01); *F15B 2211/50518* (2013.01); *F15B 2211/5153* (2013.01); *F15B 2211/6652* (2013.01); *F15B 2211/755* (2013.01)

(58) Field of Classification Search
USPC ..... 91/408, 409, 394, 405, 26
See application file for complete search history.

(56) References Cited

U.S. PATENT DOCUMENTS 3,002,497 A * 10/1961 Gulick ..... F02K 1/76 137/624.27
4,151,784 A * 5/1979 Fussangel ..... F16F 9/346 188/285
4,210,064 A * 7/1980 Beerens ..... F01B 11/02 91/394
5,284,083 A * 2/1994 Vaslin ..... B64C 25/22 60/406
5,361,211 A * 11/1994 Lee ..... E02F 9/123 340/679

FOREIGN PATENT DOCUMENTS

DE 9418129 2/1995
EP 1426499 6/2004
FR 2250036 A1 * 5/1975 ..... F15B 15/223

OTHER PUBLICATIONS

FR 2250036 A1 machine translation to English from espacenet. 1975.*
DE 3825453 A1 machine translation to English from espacnet. 1990.*
International Search Report issued by the European Patent Office in International Application PCT/DE2013/000693.

* cited by examiner

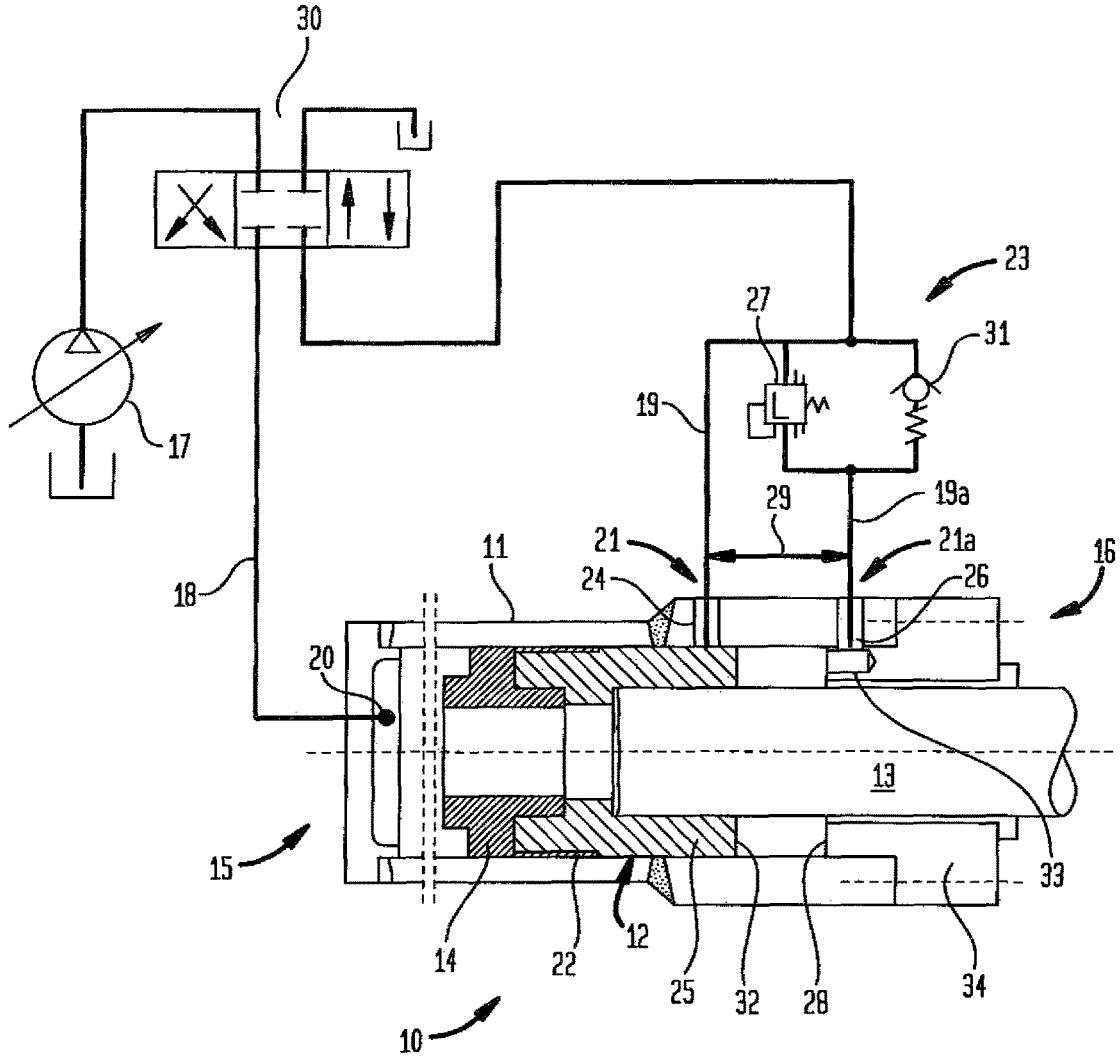
30
23
27
31
19
17
29
19a
21
21a
11
16
24
26
18
20
13
15
33
14
22
12
25
32
28
34
10

HYDRAULIC CYLINDER WITH END POSITION DAMPING

CROSS-REFERENCES TO RELATED APPLICATIONS

This application is the U.S. National Stage of International Application No. PCT/DE2013/000693, filed Nov. 12, 2013, which designated the United States and has been published as International Publication No. WO 2014/086327 and which claims the priority of German Patent Application, Serial No. 10 2012 024 155.0, filed Dec. 4, 2012, pursuant to 35 U.S.C. 119(a)-(d).

BACKGROUND OF THE INVENTION

The present invention relates to a hydraulic cylinder with end position damping including at least one cylinder in which at least one piston is arranged that is connected to at least one piston rod and is displaceable in axial direction, wherein the piston divides the cylinder into a piston side and a piston-rod side and the hydraulic oil, required for actuation of the piston, is pumped from a hydraulic pump via inlet and outlet lines through inlet and outlet bores provided on the cylinder. The invention also relates to a shovel excavator having the hydraulic cylinder according to the invention.

End position damping is required for numerous machines and devices, wherein masses in motion have to be decelerated within defined standards. Thus end position damping ensures a soft deceleration of the hydraulic cylinder's speed at both of its end positions or also only at one end position in order to prevent damage to the piston or the respective end position of the chamber due to a high velocity impact of the piston. This is required because the systems for agricultural and construction machines not only have to meet high standards concerning durability during operation, but also increased functionality and in some cases health-relevant demands for comfort are considered imopeningant. High performance machines therefore require means that are able to absorb impacts and vibrations so as to efficiently protect humans and machines from overload. This is also intended to reduce noise pollution of the environment.

For this purpose dampers are known from the state of the art that operate based on a throttling of the fluid flow. Thereby, the kinetic energy resulting from the movement is converted into heat. The kinetic energy E as the product of all masses m acting on the piston rod and the stroke speed v at the beginning of the damping should not exceed the working volume W of the damping. It is generally known that this may be realized at the end positions by means of additions to the hydraulic cylinder having damping pistons with a smaller cross-section.

For instance, a piston or a tappet seals an outlet opening that is provided for drainage of hydraulic oil, as soon as the piston in the hydraulic cylinder is fully retracted or extended. Thereby, the hydraulic oil is forced to flow out of the cylinder chamber through a bypass that has a smaller cross-section than the outlet opening. The cross-section of the bypass is usually adjustable through a grub screw. Hereby, the cylinder is significantly slowed down and damped until reaching its end position.

These end position damping systems have proven their worth; however, they have the disadvantage that end position damping is achieved through additional components in and on the hydraulic cylinder. Furthermore, the adjustability and the calibration of the end position damping through grub screws or comparable means does not function entirely without difficulties due to the fact that an over- or under-damping may cause damage to the hydraulic cylinder. Additionally, electrical measuring technology is used in order to prevent the piston to impact the mechanical stops at full speed. The overall system may suffer considerable damage in the case of failure of the components that have been additionally included in the cylinder.

SUMMARY OF THE INVENTION

It is therefore an object of the present invention to provide a hydraulic cylinder with a self-regulating, electronic/hydraulic end position damping by which the aforementioned disadvantages may be remedied.

This object is achieved by the features set forth in the independent claim, in particular in that a mechanical pre-throttling is assigned to the cylinder, via which pre-throttling the hydraulic oil can be discharged through a first bore during displacement of the piston until the piston, during its displacement, closes the first bore and the hydraulic oil is thus discharged through a second bore, from where it is conducted to a pressure relief valve that forces the hydraulic pump at a preset pressure into an electronically regulated pressure cut-off function that reduces the delivery rate of the hydraulic oil and the piston can be moved into its end position in a decelerated manner. Hereby, a damping of the piston's impact at the end of its travel path within the cylinder is achieved, which enables a simple and robust end position damping without requiring further components within the cylinder. Through the constructive arrangement on the piston and on the cylinder and the addition of two valves to the cylinder hydraulics, a self-regulating electronic/hydraulic end position damping is achieved.

In an advantageous embodiment of the hydraulic cylinder according to the invention, it is provided to configure the pre-throttling as a pressure relief valve and to connect it to the hydraulic pump through a hydraulic line and a (4/3) way control valve with a blocking center position.

In a further particularly advantageous embodiment of the hydraulic cylinder according to the invention, the pre-throttling is connected to the first bore and the second bore via hydraulic lines and the first bore is closed by the piston skirt when the piston moves to the end position of the piston rod side, wherein during the movement of the piston the piston head is moved in front of the second bore with a residual stroke remaining, so that access to the second bore is closed by the piston head.

In a further particularly advantageous embodiment of the hydraulic cylinder according to the invention, the first bore is arranged spaced apart from the second bore so that the distance between the first and the second bores corresponds to the path the piston travels during the time required by the hydraulic pump to switch from a maximum feed rate to a minimum feed rate.

In a further embodiment of the hydraulic cylinder according to the invention, the bores are arranged on the hydraulic cylinder radially outwardly in the region of the piston rod side. It is also conceivable that the second bore—as opposed to the first bore—is embedded parallel to the piston rod at the end position and is guided radially outwardly through a connection in the region of the piston rod side.

It is provided to arrange the end position damping in particular within a hydraulic cylinder, which is in particular designed as a flap cylinder. In a further advantageous embodiment the flap cylinder is assigned to a shovel excavator. The end position damping according to the invention may be provided in a variety of hydraulic cylinders for hydraulic machines. These are expressly not limited to a flap cylinder.

A further object of the present invention is to provide a shovel excavator which includes the hydraulic cylinder according to the invention.

BRIEF DESCRIPTION OF THE DRAWING

In the following, the invention is explained in more detail by way of an exemplary embodiment with reference to the enclosed drawing. The sole FIGURE shows:

FIG. a schematic sectional view through the hydraulic cylinder according to the invention, to which a 4/3 way control valve with a center blocking position with connected hydraulic pump is assigned, which valve is connected to the piston side and the piston rod side of the hydraulic cylinder via lines, wherein a mechanical prethrottling is arranged in the line of the piston rod side which is formed by a pressure relief valve and a non-return valve.

DETAILED CESCRIPTION OF PREFERRED EMBODIMENTS

As shown in the sole Figure, the hydraulic cylinder 10 essentially consists of a cylinder 11 within which a piston 12 is arranged that is connected to a nut 14. The piston 12 is moveable in axial direction, wherein the cylinder 11 is divided by the piston 12 into a piston side 15 and a piston rod side 16. The piston side 15 is sealed against the piston rod side by a gasket 22, which is arranged radially outwardly on the piston 12. The hydraulic oil required to actuate the piston 12 is pumped by a hydraulic pump 17 via inlet- and outlet lines 18 and 19 and 19*a* through inlet 20 and outlet openings 21, 21*a*. The piston 12 is guided in a guide 34.

The cylinder 11 is assigned a mechanical pre-throttling 23. Via the mechanical pre-throttling, the hydraulic oil can be discharged on the piston rod side 16 through a first bore 24 during the movement of the piston 12 until the piston 12 closes the first bore 24 with its piston skirt 25. The hydraulic oil is slowly throttled and then discharged through a second bore 26, from where it is conducted to a pressure relief valve 27 as component of the pre-throttling 23. The second bore 26 is provided in the area of the end position 28 at the piston rod side 16 of the hydraulic cylinder 10, where it is connected via a opening 33 to the end position 28. Hereby, the piston 12 may be moved into direct proximity of the end position 28 (with a residual stroke remaining) so that the entire hydraulic oil on the piston rod side 16 can be drained through the outlet opening 21*a* which is assigned to the second bore 26. The piston head 32 of the piston 12 is hereby moved in front of the second bore 26 with the residual stroke remaining. As a result, access via the opening 33 to the second bore 26 is closed by the piston head 32 so that hydraulic oil is prevented from reaching the second bore.

At a preset pressure the pressure relief valve 27 forces the hydraulic pump 17 into an electronically regulated pressure cut-off function. This means that the hydraulic pump 17 only operates with a low delivery rate on the piston side 15. This means that the pressure remains constant and only the delivery rate changes.

The delivery rate of the hydraulic oil on the piston side 15 is reduced by the pressure cut-off function and the piston 12 thus can be moved into its end position 28 on the piston rod side 16 in a decelerated manner. Hereby the pressure relief valve 27 is connected via the hydraulic line 19 for example with a (4/3) way control valve 30 (with center blocking position) to the hydraulic pump 17.

As the Figure also shows, the first bore 24 is arranged at a distance 29 to the second bore 26. The distance 29 between the first bore 24 and the second bore 26 corresponds to the path the piston 12 travels in the time required by the hydraulic pump 17 to switch from a maximum delivery rate to a minimum delivery rate. The mechanical pre-throttling 23 furthermore has a non-return valve 31. The non-return valve 31 ensures that the hydraulic oil, when flowing out of the opening 21*a* via the bore 26 into the outlet line 19*a*, can flow into the pressure relief valve 27 and is not directly pushed into the outlet line 19. In addition, the non-return valve 31 supports the return movement. This means that the non-return valve 31 opens in case of a reversal of flow and enables a pressure-free (i.e. low-loss) filling and return movement of the piston 12 in the cylinder 11. This may be associated with the opening of a flap on a shovel excavator (not shown).

What is claimed:

1. A hydraulic cylinder, comprising:

a cylinder having an axially spaced-apart first bore directly connected to a first outlet line and a second bore directly connected to a second outlet line;

a piston having a piston rod, said piston being arranged in the cylinder for movement between two end positions and dividing the cylinder into a piston side and a piston-rod side;

a hydraulic pump pumping hydraulic oil via an inlet line into the piston side at a preset pressure to move the piston from one of the end positions in a direction toward the other one of the end positions while hydraulic fluid is discharged from the piston-rod side via the first bore and the first outlet line;

a mechanical throttling device including a pressure relief valve and a non-return valve, said mechanical throttling device operably connected to the cylinder to throttle a flow of the hydraulic fluid as the piston moves past and seals the first bore so that hydraulic fluid is discharged via the second bore, thereby reducing a delivery amount of the hydraulic oil and thereby braking and damping a movement of the piston toward the other one of the end positions, wherein the pressure relief valve and the non-return valve are arranged on the second outlet line, wherein the piston includes a piston skirt to close the first bore during movement of the piston to one of the end positions, and a piston head to close access to the second bore during movement of the piston to the other one of the end positions in front of the second bore;

a guide arranged at the piston-rod side for guiding the piston, wherein the first bore is guided radially outwardly of the cylinder in a region of the piston-rod side;

a connection formed as a blind hole in the guide so as to extend parallel to the piston rod and is laterally connected to the second bore in the other of the end positions, wherein the second bore is guided radially outwardly of the cylinder in a region of the piston side via the connection formed as the blind hole, wherein the blind hole is closeable by the piston head in the other end position of the piston, wherein the piston skirt has an outer circular cylindrical surface with which the piston skirt closes the first bore during movement of the piston to the one end position, and wherein the piston head has a flat circular axial end surface with which the piston head closes the blind hole during movement of the piston to the other end position.

2. The hydraulic cylinder of claim 1, further comprising a directional control valve, wherein the pressure relief valve is operatively connected to the hydraulic pump via the first outlet line and the directional control valve.

3. The hydraulic cylinder of claim 2, wherein the non-return valve is configured to force hydraulic fluid to flow through the pressure relief valve, when being discharged from the piston-rod side through the second bore.

4. The hydraulic cylinder of claim 1, wherein the first bore and the second bore are spaced apart by a fixed distance which is designed to correspond to a path the piston travels during a time required by the hydraulic pump to switch from a maximum delivery rate to a minimum delivery rate.

5. The hydraulic cylinder of claim 4, wherein the first bore and the second bore are arranged radially outwardly on the cylinder in a region of the piston-rod side.

6. The hydraulic cylinder of claim 4, further comprising a guide arranged at the piston-rod side for guiding the piston, wherein the first bore is arranged radially outwardly on the cylinder in a region of the piston-rod side, wherein a connection is embedded in the guide so as to extend parallel to the piston rod, said connection being connected to the second bore in the other one of the end positions, said second bore being guided radially outwardly on the cylinder in a region of the piston side via the connection.

7. The hydraulic cylinder of claim 1 constructed as a dump cylinder.

8. A shovel excavator, comprising:

a hydraulic cylinder, said hydraulic cylinder comprising a cylinder having an axially spaced-apart first bore directly connected to a first outlet line and a second bore directly connected to a second outlet line, a piston having a piston rod and arranged in the cylinder for movement between two end positions and dividing the cylinder into a piston side and a piston-rod side, a hydraulic pump pumping hydraulic oil via an inlet line into the piston side at a preset pressure to move the piston from one of the end positions in a direction toward the other one of the end positions while hydraulic fluid is discharged from the piston-rod side via the first bore and the first outlet one, and a mechanical throttling device including a pressure relief valve and a non-return valve, said mechanical throttling device operably connected to the cylinder to throttle a flow of the hydraulic fluid as the piston moves past and seals the first bore so that hydraulic fluid is discharged via the second bore, thereby reducing a delivery amount of the hydraulic oil and thereby braking and damping a movement of the piston toward the other one of the end positions, wherein the pressure relief valve and the non-return valve are arranged on the second outlet line, wherein the piston includes a piston skirt to close the first bore during movement of the piston to one of the end positions, and a piston head to close access to the second bore during movement of the piston to the other one of the end positions in front of the second bore;

a guide arranged at the piston-rod side for guiding the piston, wherein the first bore is guided radially outwardly of the cylinder in a region of the piston-rod side;

a connection formed as a blind hole in the guide so as to extend parallel to the piston rod and is laterally connected to the second bore in the other of the end positions, wherein the second bore is guided radially outwardly of the cylinder in a region of the piston side via the connection formed as the blind hole, wherein the blind hole is closeable by the piston head in the other end position of the piston, wherein the piston skirt has an outer circular cylindrical surface with which the piston skirt doses the first bore during movement of the piston to the one end position, and wherein the piston head has a flat circular axial end surface with which the piston head closes the blind hole during movement of the piston to the other end position.

* * * * *